US006540417B1

(12) United States Patent
Noguchi

(10) Patent No.: US 6,540,417 B1
(45) Date of Patent: Apr. 1, 2003

(54) STENCIL MAKING APPARATUS

(75) Inventor: Ikuo Noguchi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 351 days.

(21) Appl. No.: 09/604,058

(22) Filed: Jun. 26, 2000

(30) Foreign Application Priority Data

Jun. 29, 1999 (JP) ..... 11-183693

(51) Int. Cl.[7] ..... B41J 2/315

(52) U.S. Cl. ..... 400/120.01; 400/120.05; 400/124.05; 101/128.21; 101/128.4; 347/171

(58) Field of Search ..... 400/124.01–124.05, 400/118.2, 120.01–120.18; 101/127, 114, 128.4; 347/171–196

(56) References Cited

U.S. PATENT DOCUMENTS 5,245,932 A * 9/1993 Ujiie ..... 101/128.21
5,355,793 A 10/1994 Sato et al. ..... 101/128.21
5,491,503 A * 2/1996 Fuwa ..... 101/128.4
5,902,053 A 5/1999 Ikemoto et al. ..... 400/120.07

OTHER PUBLICATIONS

Patent Abstracts of Japan, vol. 015, No. 190 (M–1113), May 16, 1991 & JP03–047760 A (Sony Corp), Feb. 28, 1991.

* cited by examiner

*Primary Examiner*—Leslie J. Evanisko
*Assistant Examiner*—Minh H. Chau
(74) *Attorney, Agent, or Firm*—Kanesaka & Takeuchi

(57) ABSTRACT

A stencil making apparatus thermo-sensitively perforates a stencil sheet by a thermal print head. The apparatus includes a controlling device for driving contiguous N pieces of heat generating elements of the thermal print head while shifting respectively heat generating timings at every 1/N of a period of one line of main scanning in perforating inputted image data of the one line of the main scanning.

2 Claims, 7 Drawing Sheets

STENCIL MAKING APPARATUS

BACKGROUND OF THE INVENTION

1. Field of the Invention

The present invention relates to a stencil making apparatus for thermo-sensitively perforating stencil sheet, particularly to an apparatus and a method of stencil making capable of restraining occurrence of moire on stencil sheet as perforated.

2. Description of the Related Art

In a stencil printer or the like, there is provided a stencil making apparatus for perforating stencil sheet used in printing. The stencil making apparatus perforates stencil sheet by applying heat thereto. The perforated stencil sheet is transferred to a printing section and image is formed on print sheet by supplying ink from the perforation.

The stencil sheet is grossly classified into two kinds, that is, 1) one constituted by film and gauze (supporter having mesh structure) and 2) one comprising film and Japanese paper. Particularly, the stencil sheet of 1) is frequently used in a simplified type stencil printer.

In the following, an explanation will be given of a stencil making apparatus for perforating stencil sheet by using a supporter having a mesh structure of 1).

The stencil making apparatus is provided with a thermal print head and a platen and stencil sheet is thermal-sensitively perforated by the thermal print head while feeding the stencil sheet in a direction orthogonal to the thermal print head by rotating the platen. At this occasion, in producing stencil image, main scanning is carried out in the width direction of the stencil sheet by the thermal print head and sub-scan is carried out in the length direction of the stencil sheet by rotating the platen.

FIGS. 6(*a*) and 6(*b*) are drawings showing a perforated state of stencil sheet.

As shown by FIG. 6(*a*), perforations K on stencil sheet S are formed by the resolution of a thermal print head (pitch P1 of arranging heat generating members). As illustrated, arrangement of the perforations K is formed in one straight line directed in a main scanning direction X of the thermal print head (direction of arranging heat generating members). Further, the perforations K are formed by a predetermined pitch P2 (P1=P2 in the illustrated example) in a sub scan direction Y for forming image.

As shown by FIG. 6(*b*), supporters ST of the stencil sheet S are formed in a mesh-like shape and vertically and horizontally arranged regularly at a predetermined pitch P3 in directions the same as the directions of arranging the perforations K (main scanning direction X and sub scan direction Y).

However, in the case of perforation using stencil sheet constituted by a film and the supporters having the mesh structure, depending on combinations of the resolutions P1 (P2) of the thermal print head and the mesh pitch P3 of the supporters of the stencil sheet, there is a case in which significant moire occurs on the stencil sheet as perforated. The moire occurs similarly on print sheet as printed.

For example, when the resolution P1 of the thermal print head and the pitch P2 of sub scan are 300 dpi (P1=84.67 $\mu$m) and the pitch P3 of the mesh is 200 dpi (P3=127 $\mu$m), the respective pitches establish a relationship of 3:2, a predetermined regularity is produced therebetween and accordingly, there occurs moire which is easily recognizable by optical observation.

Most significant moire occurs when the resolution of the thermal print head and the pitch of the mesh are provided with similar values (dpi).

Conversely, by adequately combining the resolution of the thermal print head and a mesh interval of the stencil sheet, moire can be made comparatively inconspicuous by diminishing the regularity between the pitches of both. However, in recent years, the both values (dpi) are proximate to each other by improvement of the resolution and it is difficult to dispense with occurrence of moire.

Otherwise, in order to suppress moire, there is provided a method in which a direction of arranging mesh of supporters and a main scanning direction of a thermal print head are inclined relative to each other such that the directions are not orthogonal to each other. In this case, the thermal print head must be attached to be inclined to a transfer direction of stencil sheet and therefore, structure of a stencil machine becomes complicated and the transfer becomes unstable.

Further, although it is conceivable to incline the direction of arranging the mesh of the supporters in fabricating the stencil sheet, the constitution is very inefficient in view of production and is not practical.

The present invention has been carried out in order to resolve the above-described problem and it is an object of the present invention to provide an apparatus and a method of stencil making capable of diminishing occurrence of moire by perforating stencil sheet having supporters in an arrangement having a regularity.

SUMMARY OF THE INVENTION

In order to achieve the above-described object, according to a first aspect of the present invention, there is provided a stencil making apparatus for thermal-sensitively perforating stencil sheet by a thermal print head, the stencil making apparatus comprising controlling means for driving contiguous N pieces of heat generating elements of the thermal print head while shifting heat generating timings at every 1/N of a period of one line of main scanning in perforating inputted image data of the one line of the main scanning.

Further, according to a second aspect of the present invention, there is provided a stencil making apparatus for perforating stencil sheet having supporters in a mesh structure having a regular pitch, the stencil making apparatus comprising a thermal print head arranged with a plurality of pieces of heat generating members at a regular pitch and controlling means for dividing inputted image data of one line of main scanning such that contiguous N pieces of the heat generating elements of the thermal print head generate different lines of print data of N lines divided into 1/N of the period of the one line and outputting the N lines of the print data to the thermal print head at different timings.

Further, according to a third aspect of the present invention, there can be constructed a constitution in which the controlling means outputs the N lines of the print data to the thermal print head during a time period of the period of the one line of the main scanning.

Further, according to a fourth aspect of the present invention, there may be constructed a constitution further comprising setting means for setting a value of N (at least, N is equal to or larger than 2) such that a regularity is diminished in a relationship between a pitch of supporters of the stencil sheet and a pitch of the heat generating members of the thermal print head, wherein the controlling means controls to divide the print data of the N lines based on the value of N set by the setting means and output timings thereof.

According to a fifth aspect of the present invention, there is provided a stencil making method of thermal-sensitively perforating stencil sheet by a thermal print head wherein in perforating inputted image data of one line of main scanning, contiguous N pieces of heat generating elements of the thermal print head are driven while respectively shifting heat generating timings at every 1/N of a period of the one line of the main scanning.

According to the above-described constitution, in the thermal print head, contiguous heat generating members do not generate heat simultaneously but generate heat at timings different from each other and accordingly, an angle may be constituted between the stencil sheet and a main scanning direction of the thermal print head.

Thereby, even in the case in which a regularity is present between a mesh pitch of the supporters of the stencil sheet and the resolution of the thermal print head, the regularity can be diminished and occurrence of moire on the stencil image can be diminished.

DETAILED DESCRIPTION

Figure 6A:
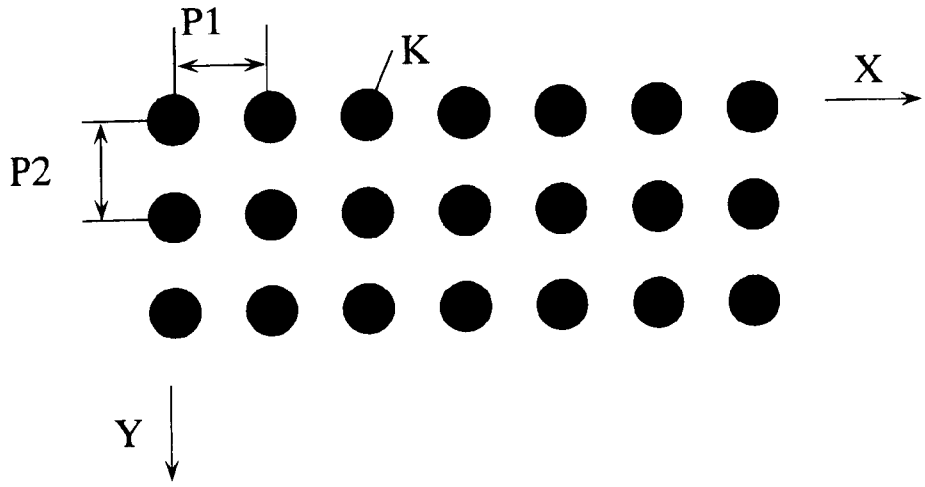
FIGS. 6(*a*) and 6(*b*) are drawings showing a perforated state of stencil sheet according to a conventional technology.
Figure 6B:
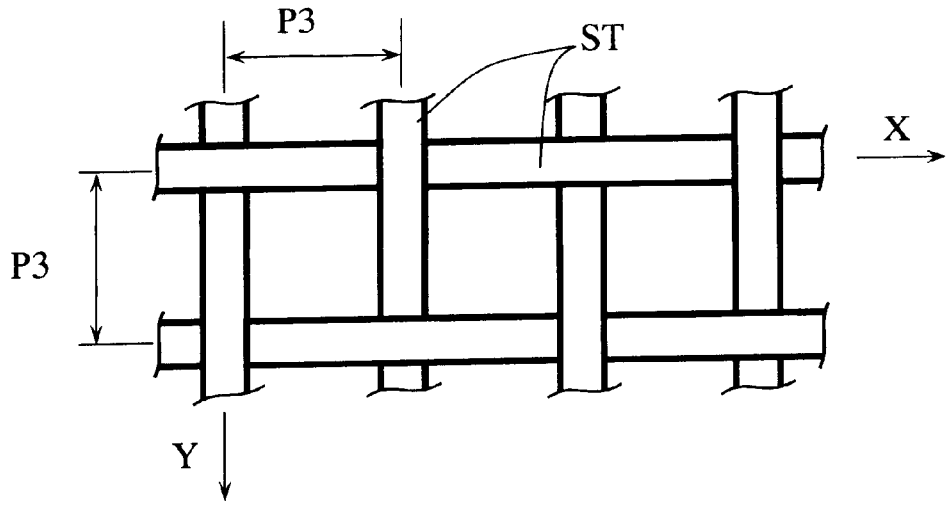

The stencil sheet S used in the present invention is constituted by the film and the gauze (supporters having mesh structure) shown by FIGS. 6(*a*) and 6(*b*). Further, the supporters are provided with regularity at the predetermined pitch P3 in directions respectively orthogonal to the width and the length directions of the stencil sheet S.

Figure 1:
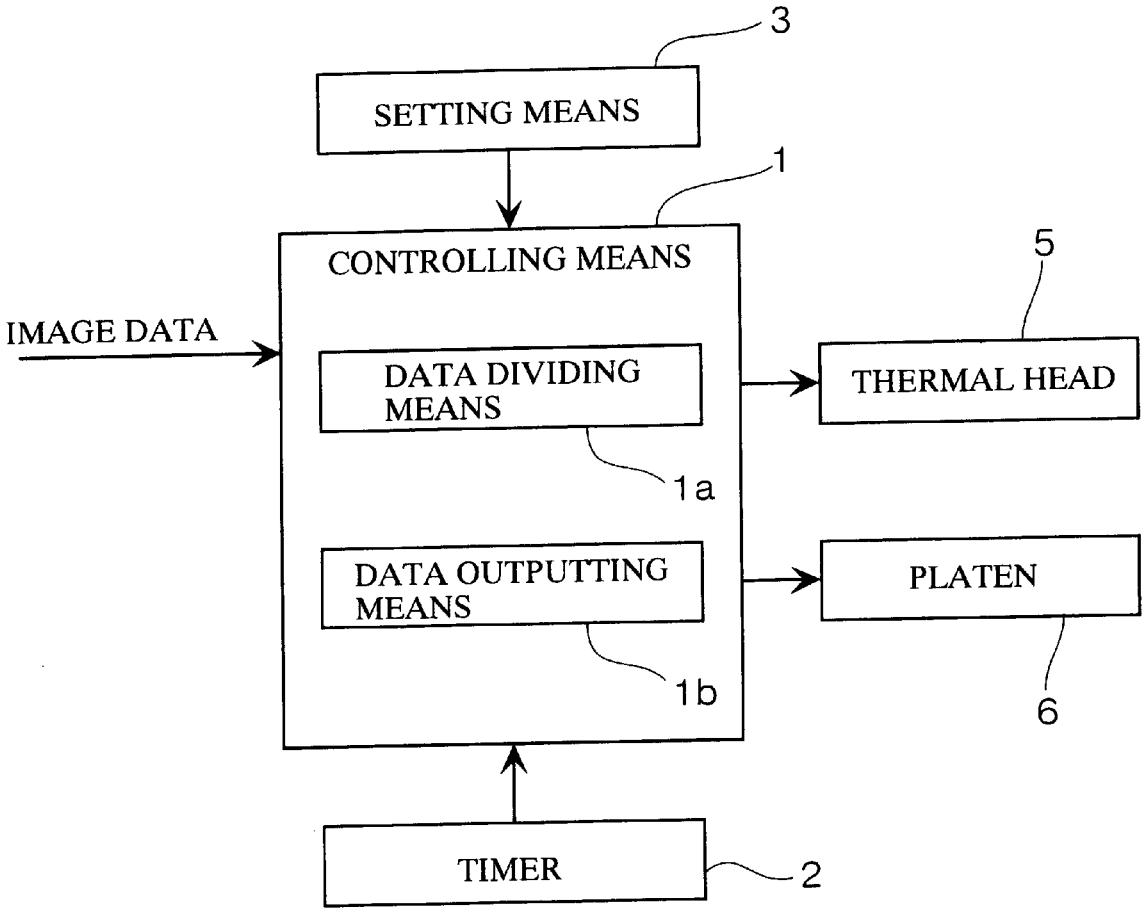
FIG. 1 is a block diagram of a first embodiment of stencil making apparatus according to the present invention.
Figure 2:
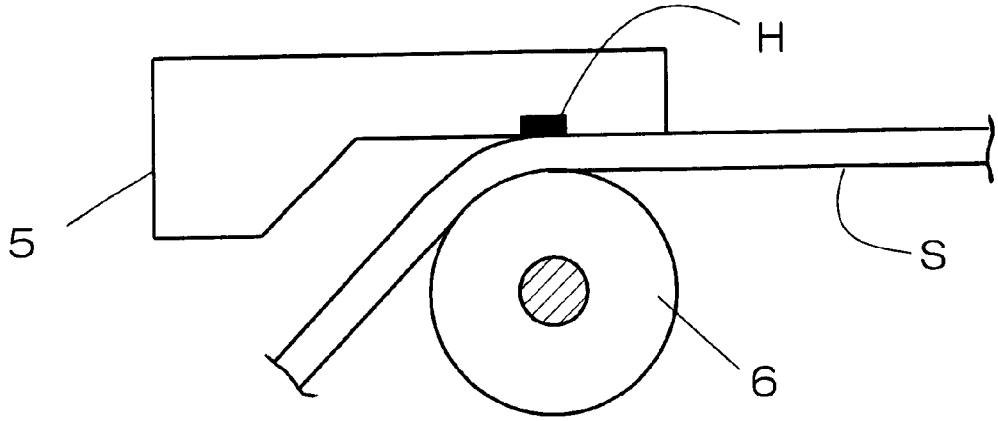
FIG. 2 is a side view showing structure of the stencil making apparatus.

FIG. 1 is a block diagram showing constitution of a first embodiment of a stencil making apparatus according to the present invention and FIG. 2 is a side view showing structure of the stencil making apparatus.

Controlling means 1 is constituted by a processor such as CPU and storage sections such as ROM, RAM and the like. The controlling means 1 is inputted with image data for stencil making from outside.

The controlling means 1 divides inputted image data of one line of the thermal print head by N and outputs print data to a thermal print head 5 in N times. The notation N designates a number of selection in a plurality of heat generating members H which are contiguous to each other in the thermal print head 5.

Setting means 3 is set with the number of N divisions. The storage sections of the controlling means 1 may be used for the setting means 3.

The thermal print head (TPH) 5 is constituted by linearly arranging the plurality of head generating members H ($H_{-1}$ through $H_{-N}$; N is a natural number equal to or larger than 1) at the predetermined pitch P1. The respective heat generating members H are arranged in the depth direction of drawing in FIG. 2. Portions of the stencil sheet S in correspondence with the heated heating members H, are perforated by heat.

There is provided a platen roller 6 to be opposed to the thermal print head 5. The controlling means 1 transfers stencil sheet S in the length direction by rotating the platen roller 6 in the perforating operation.

Further, the heat generating members H in correspondence with image data in the length direction of the thermal print head 5, generate heat and the perforating operation is carried out by main scanning of 1 line. Thereafter, after carrying out sub scan of rotating the platen roller 6 by a predetermined amount, the perforating operation is carried out by main scanning of a second line spaced part from the above-described line by the predetermined pitch P2. Thereafter, by main scanning of a plurality of lines, stencil image in correspondence with image data is perforated on the stencil sheet S.

Both of the length and the width directions of the thermal print head 5 coincide with those of the stencil sheet S and the thermal print head 5 is not inclined thereto.

The controlling means 1 is provided with data dividing means la for dividing the inputted image data into N divisions by a procedure, mentioned later and data outputting means 1*b* for outputting print data which has been divided into N divisions by the data dividing means 1*a* at respective predetermined timings. These means are operated based on time information of a timer 2.

Further, the rotational speed of the platen roller 6 (speed of sub scan) stays constant and the data outputting means 1*b* divides a time period of the pitch P2 of sub scan (corresponding to a period of main scanning of 1 line) equally by N and transmits respective print data to the thermal print head 5 by N times.

Next, an explanation will be given of operation by the above-described constitution.

Figure 3:
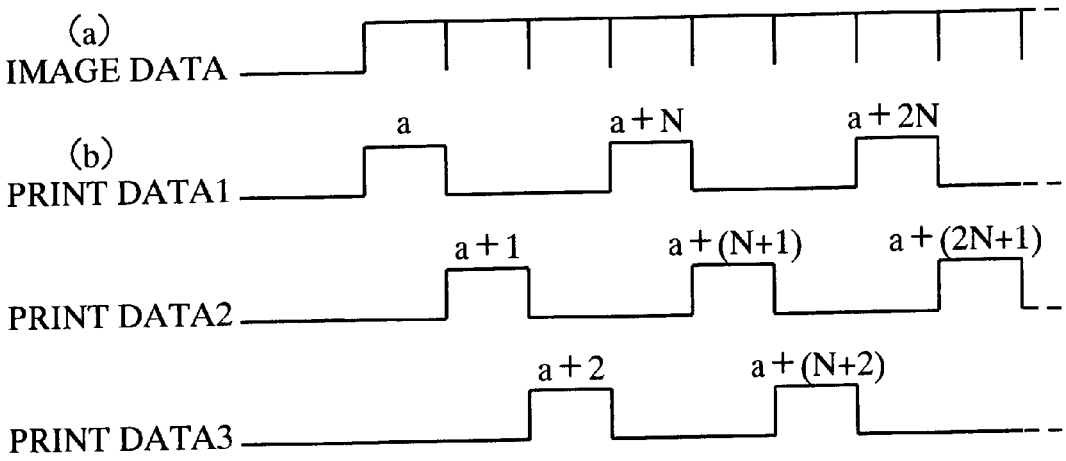
FIG. 3 illustrates time charts showing data of perforation.

FIG. 3 illustrates timing charts showing print data outputted from the controlling means 1. In the drawings, the abscissa designates time axis in the main scanning direction X and the ordinate designates a time axis of the sub scan direction Y.

In this case, the setting means 3 is set with N=3.

FIG. 3(*a*) shows image data inputted to the controlling means 1 and in the illustrated example, for convenience, it is assumed that the image data is constituted only by data for making the respective heat generating members H of the thermal print head 5 generate heat. Perforated image of one line is formed in the main scanning direction X by print data 1 through 3, although a description thereof will be given later. Further, the image data is constituted only by the data for making the respective heat generating members 1 generate heat to thereby thermal-sensitively perforate the line in a linear shape.

The data dividing means 1*a* of the controlling means 1 converts the inputted image data into data having a period of 3 pixels (N=3) on one line as illustrated.

Further, the data outputting means 1*b* controls a period of transmitting a total of 3 lines of print data.

As shown by FIG. 3(*b*), with regard to print data 1 at a first line, successive to image data "a" of a first pixel of the inputted image data, there is transmitted image data (a+N) at a third pixel spaced apart from the image data "a" by an interval of two pixels of image data.

With regard to print data 2 of a second line, successive to image data (a+1) of a second pixel of the inputted image data, there is transmitted image data (a+N+1) of a fourth pixel spaced apart from the image data (a+1) by an interval of two pixels of image data.

With regard to print data 3 of a third line, successive to image data (a+2) of a third pixel of the inputted image data, there is transmitted image data (a+N+2) of a fifth pixel spaced apart from the image data (a+2) by an interval of two pixels of image data.

Further, although not illustrated, the length of data of a total of one line corresponds to a number of the heat generating members H provided to the thermal print head 5 and the processing is carried out such that the length of previously inputted image data is adapted thereto.

Further, the image data 1 through 3 of the three lines are constituted by dividing a moving time period of the pitch P2 of sub scan by N and accordingly, during a time period of sub scan of 1 line, the thermal print head 5 transmits the print data 1 through 3 by 3 times on the same main scanning line.

Figure 4:
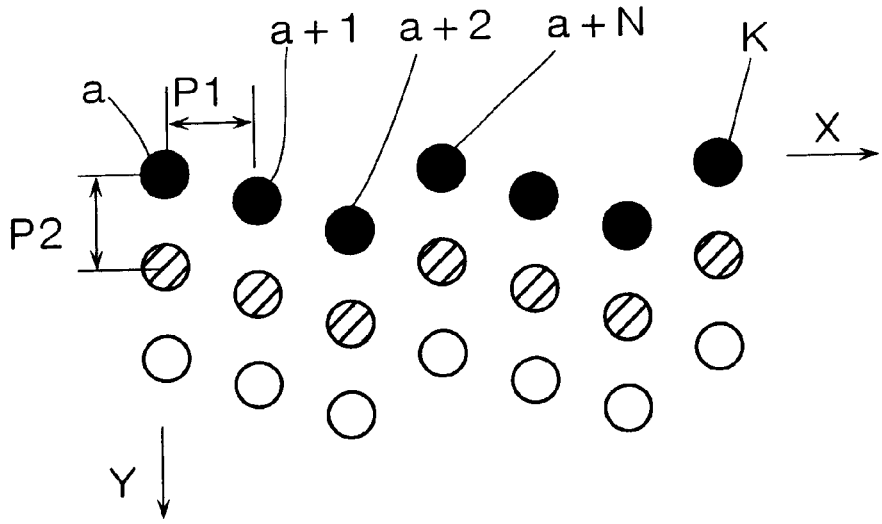
FIG. 4 is a drawing showing a perforated state in perforating operation.

FIG. 4 is a drawing showing a state of forming respective perforations perforated by the thermal print head 5 based on print data of the controlling means 1. In the drawing, there is shown a state of forming perforations K of 3 lines in correspondence with 3 image data. Further, for convenience, display of the perforations K is changed at every arrangements of respective lines of the perforations K in the drawing.

As illustrated, in the main scanning direction, the respective perforations K are formed respectively by the pitch P1 of arranging the heat generating members H.

With regard to the sub scan direction, an interval between a first line and a fourth line constitutes the pitch P2 in the sub scan direction and the respective perforations K are formed by dividing the pitch P2 in 3.

In this case, the pitch P1 of arranging the heat generating members H and the pitch P2 in the sub scan direction are respectively 300 (dpi)=84.67 $\mu$m.

Further, as illustrated, the respective perforations K are perforated in a state in which the respective perforations K are arranged not in straight lines but obliquely in a range of set N relative to either of the main scanning direction and the sub scan direction. Thereby, even in the case in which the mesh of the supporters ST of the stencil sheet S (refer to FIG. 6) is the predetermined pitch P3 (for example, 200 dpi) along the main scanning direction and the sub scan direction, the regularity between the pitch P3 of the mesh and the pitches P1 and P2 of the respective perforations K can be diminished. Therefore, occurrence of moire can be diminished.

Further, the perforations K are perforated obliquely by a unit of set N pieces and therefore, viewing very finely, the line in a linear shape indicated by the image data is formed obliquely by the unit of N pieces. However, in view of respective points of 1) point in which a number of perforations on 1 line of main scanning is set to be large in accordance with the number of the heat generating members ($H_{-1}$ through $H_{-N}$) of the thermal print head 5, 2) point in which oblique perforation is carried out within a range of 1 line of sub scan and 3) point in which oozing of ink is caused in printing operation after the stencil making operation, an influence by oblique perforation on image formed on print paper is to an unrecognizable degree.

Further, the perforations K are formed always accompanied by a time difference among contiguous ones of the heat generating members H and therefore, the contiguous ones of the perforations K are not jointed and the respective perforations K can be perforated independently from each other.

Further, thermal history control of the thermal print head 5 can be dispensed with. According to the thermal print head 5, thermal energy applied to the heat generating members H tends to accumulate and accordingly, there is generally carried out thermal history control for controlling thermal energy of the heat generating members H at current time based on past heat generation history of contiguous ones of the plurality of heat generating members H (refer to Japanese Patent Laid-Open No. 8065/1990 and the like).

However, according to the above-described constitution of the present invention, contiguous ones of the heat generating members H do not generate heat simultaneously, accumulation of thermal energy undergoing influence of heat generation of surrounding ones of the heat generating members H is not produced and accordingly, the above-described thermal history control is not needed.

Further, according to the above-described constitution, a number of the heat generating members H simultaneously generating heat in the thermal print head 5 becomes 1/N thereof. Therefore, peak current supplied to the thermal print head 5 can be restrained to 1/N of the conventional case at maximum. Thereby, small capacity formation of power supply and reduction of wiring capacity can be achieved.

Although according to the above-described embodiments, a number of selecting contiguous ones of the heat generating members H (number of dividing data) is set to 3, the present invention is not limited thereto but effect of diminishing moire can be achieved so far as N is equal to or larger than 2. The number of N may be set to a desired value capable of diminishing the regularity of the relationship between the resolution of the thermal print head 5 (pitch P1 of heat generating member H) and the mesh pitch P3 of the supporters of the stencil sheet S.

Further, although according to the above-described embodiment, with regard to the perforations K by the thermal print head 5, an explanation has been given such that the pitch P1 of main scanning and the pitch P2 of sub scan are the same as each other, it is not necessary that the pitches P1 and P2 are the same. Further, the pitch P2 on the side of sub scan can be made variable arbitrarily.

For example, when the pitch P2 on the side of sub scan is enlarged, an angle of arrangement of the plurality of perforations K within a range of N is increased relative to the main scanning direction X and when the pitch P2 on the side of sub scan is narrowed, the angle of arrangement by the plurality of perforations K within the range of N can be reduced relative to the main scanning direction X.

Also with regard to the pitch P2 on the side of sub scan, the pitch P2 may be set to a desired value capable of reducing the regularity of the relationship between the pitch P2 and the mesh pitch P3 of the supporters of the stencil sheet S.

Figure 5:
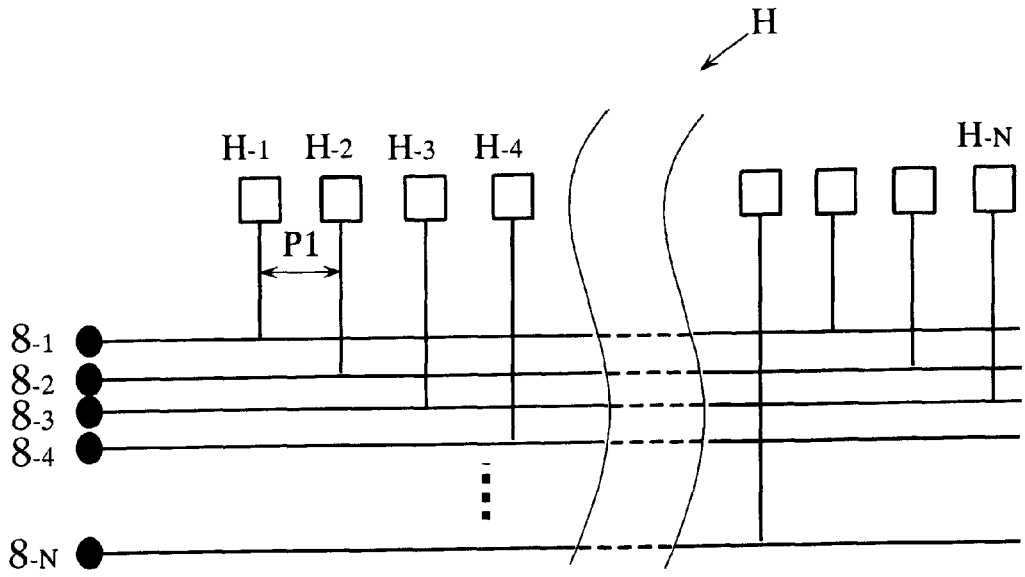
FIG. 5 is a drawing showing constitution of a second embodiment according to the present invention.

Next, an explanation will be given of a second embodiment of the present invention in reference to FIG. 5.

The thermal print head 5 is arranged with the respective heat generating members H ($H_{-1}$ through $H_{-N}$) at the predetermined pitch P1 in compliance with the resolution.

The respective heat generating members $H_{-1}$ through $H_{-N}$ are connected to control lines $\mathbf{8}_{-1}$ through $\mathbf{8}_{-N}$ such that contiguous ones of the heat generating members connected thereto are connected to different control lines.

For example, in the case of N=3, 3 pieces of the control lines $\mathbf{8}_{-1}$ through $\mathbf{8}_{-3}$ are used. The control line $\mathbf{8}_{-1}$ is connected with the heat generating members $H_{-1}$, $H_{-4}$, . . . at every three pieces. The control line $\mathbf{8}_{-2}$ is connected with heat generating members $H_{-2}$, $H_{-5}$, . . . at every three pieces. The control line $H_{-3}$ is connected with the heat generating members $H_{-3}$, $H_{-6}$, . . . at every three pieces.

The thermal print head 5 is supplied with print data from the controlling means at respectively different timings via 3 pieces of the control lines $\mathbf{8}_{-1}$ through $\mathbf{8}_{-3}$.

In this case, unless the print data is simultaneously supplied to the respective control lines $\mathbf{8}_{-1}$ through $\mathbf{8}_{-3}$, output timings of the print data to the control lines $\mathbf{8}_{-1}$ through $\mathbf{8}_{-3}$ differ from each other.

Thereby, the regularity of the relationship between the resolution of the thermal print head 5 (pitch P1 of heat generating member H) and the mesh pitch P3 of the supporters of the stencil sheet S can be diminished and occurrence of moire can be prevented.

The controlling means 1 may divide over time a plurality of print data constituting image of 1 line on the stencil sheet S and output the print data. Therefore, outputs of respectively divided print data may randomly be outputted in images of respective lines (unit of sub scan) within a range of N=3 (within range of pitch P2 of sub scan).

According to the present invention, there is constructed the constitution in which contiguous N pieces of heat generating elements of a thermal print head are driven while shifting heat generation timings at every 1/N of a period of 1 line of main scanning and accordingly, when perforating inputted image data of 1 line of main scanning, N pieces of the heat generating members do not generate heat simultaneously but generate heat at different timings.

Thereby, perforations of stencil sheet can be perforated independently from each other. Further, thermal history control with regard to the thermal print head can be dispensed with.

Further, even in the case in which there is a regularity between resolution of the thermal print head and pitch of supporters of stencil sheet, the regularity can be diminished and occurrence of moire on image after perforating operation can be diminished. Particularly, there is achieved a significant effect in perforating operation using stencil sheet in which a gauze having a regular mesh pitch is used for the supporters.

According to the above-described effect, moire can be suppressed without changing the resolution of the thermal print head, the structure of the thermal print head per se and attaching structures thereof, further, while using stencil sheet constituted by supporters having a regularity in mesh pitch.

In addition thereto, according to the thermal print head, the heat generating elements are divided into N divisions and are driven at timings respectively different from each other and accordingly, power supply for supplying power to the thermal print head and capacity of wirings can be reduced to 1/N thereof and the cost related to a power supply apparatus can be reduced.

What is claimed is:

1. A stencil making apparatus for perforating stencil sheet having supporters in a mesh structure having a regular pitch, said stencil making apparatus comprising:

a thermal print head having a plurality of heat generating members arranged at a regular pitch;

setting means for setting a value of N, which is equal to or larger than 2, such that a regularity is diminished in a relationship between a pitch of the supporters of the stencil sheet and a pitch of the heat generating members of the thermal print head; and controlling means electrically connected to the thermal print head and the setting means for dividing inputted image data of one line of main scanning into N lines based on the value of N set by the setting means such that contiguous N heat generating elements of the thermal print head generate different lines of print data divided into 1/N in the one line and outputting the N lines of the print data to the thermal print head at different timings.

2. The stencil making apparatus according to claim 1, wherein the controlling means outputs the N lines of the print data to the thermal print head during a time period of the one line of the main scanning.

* * * * *